US005494406A

United States Patent [19]

Takada et al.

[11] Patent Number: 5,494,406

[45] Date of Patent: Feb. 27, 1996

[54] PROPELLER FOR BOAT

[75] Inventors: Hideaki Takada; Takao Aihara; Ikuo Nakazato; Ryuichi Kimata, all of Wako, Japan

[73] Assignee: Honda Giken Kogyo Kabushiki Kaisha, Tokyo, Japan

[21] Appl. No.: 246,974

[22] Filed: May 20, 1994

[30] Foreign Application Priority Data

| | | | |
|---|---|---|---|
| May 20, 1993 | [JP] | Japan | 5-118277 |
| May 31, 1993 | [JP] | Japan | 5-128966 |
| Jun. 1, 1993 | [JP] | Japan | 5-130230 |

[51] Int. Cl.[6] ..... B63H 1/24

[52] U.S. Cl. ..... 416/43; 416/87; 416/93 A; 416/134 R; 416/139; 416/143; 416/144

[58] Field of Search ..... 416/43, 87, 93 A, 416/134 R, 139, 143, 144, 145, 244 B

[56] References Cited

U.S. PATENT DOCUMENTS

| | | | |
|---|---|---|---|
| 3,275,083 | 9/1966 | Allin | 416/134 R |
| 3,565,544 | 2/1971 | Marshall | 416/134 R |
| 4,792,279 | 12/1988 | Bergeron | 416/87 |
| 4,929,153 | 5/1990 | Speer | 416/139 |
| 5,219,272 | 6/1993 | Steiner et al. | 416/139 |

FOREIGN PATENT DOCUMENTS

| | | | |
|---|---|---|---|
| 2145479 | 3/1985 | United Kingdom | 416/93 A |

*Primary Examiner*—Edward K. Look
*Assistant Examiner*—James A. Larson
*Attorney, Agent, or Firm*—Armstrong, Westerman, Hattori, McLeland & Naughton

[57] ABSTRACT

A propeller for a boat having a plurality of recesses and a plurality of land portions arranged circumferentially alternately around an outer periphery of a propeller boss which is fitted over and connected to a propeller shaft. A boss of each of propeller blades and each of blade shafts disposed parallel to an axis of the propeller boss to rotatably support such propeller blade are accommodated in each of the recesses, and each of the land portions is provided with an exhaust passage extending axially through the land portion to permit an exhaust outlet in a body of a propelling device to be opened at a rear end face of the propeller boss. Thus, it is possible to discharge an exhaust gas from an engine through the inside of the propeller boss into water.

34 Claims, 15 Drawing Sheets

PROPELLER FOR BOAT

BACKGROUND OF THE INVENTION

1. Field of the Invention

The field of the present invention relates to a propeller for a boat.

2. Description of the Related Art

A variable-diameter type propeller for a boat is disclosed in U.S. Pat. No. 3,565,544, in which a propeller boss is fitted over and connected to a propeller shaft which is carried in a body of a propelling device to project rearwardly of the body, and a plurality of propeller blades are mounted to the propeller boss through a plurality of blade shafts disposed parallel to an axis of the propeller boss so as to surround the boss axis, so that the propeller blades can be turned between a closed position in which the propeller diameter is minimized, and an opened position in which the propeller diameter is maximized.

The exhaust system in an engine for a boat is classified broadly into two types: one being an underwater-exhaust system for releasing an exhaust gas into water through an exhaust passage extending through the propeller boss, and the other being an atmosphere exhaust system for releasing an exhaust gas into the atmosphere through an exhaust pipe arranged irrespective of the propeller. The underwater exhaust system is utilized mainly in an outboard engine, and the atmosphere exhaust system is utilized mainly in an inboard engine.

The prior art variable-diameter type propeller is used mainly in the inboard engine and hence, the underwater exhausting method is not taken into consideration at all.

A variable-thrust type propeller for a boat is disclosed, for example, in Japanese Patent Application Laid-open No. 144287/90, in which a propeller shaft supported in a body of a propelling device to project rearwardly of the body is connected with a propeller boss disposed rotatably about the propeller shaft through a torque limiting device which produces a slip, if it receives a torque equal to or more than a predetermined value, and a plurality of propeller blades are mounted to the propeller boss, such that the propeller diameter or the pitch angle can be varied.

In general, such variable-thrust type propeller includes the propeller blades and the torque limiting device arranged axially and hence, the axial length thereof is long as compared with a usual propeller having stationary blades. Thereupon, when such a conventional variable-thrust type propeller is employed, the propeller shaft carried in the body of the propelling device is formed as a long propeller shaft exclusively used for the variable-thrust type propeller. Therefore, the usual propeller cannot be mounted to the propeller shaft exclusively used for the variable-thrust type propeller without formation of an extra protrusion on the shaft. When the variable-thrust type propeller is replaced by the usual propeller, the propeller shaft must also be replaced by a short one used for the usual propeller. However, such a replacing operation is very troublesome, because of an attendant disassembling of the body of the propelling device.

SUMMARY OF THE INVENTION

Accordingly, it is an object of the present invention to provide a propeller for a boat, in which even when the propeller is of a variable diameter type, an exhaust from an engine can be discharged into water.

It is another object of the present invention to provide a propeller for a boat, which can easily be mounted to even a short propeller shaft used for a usual propeller.

To achieve the above objects, according to the present invention, there is provided a propeller for a boat, comprising a propeller shaft carried in a body of a propelling device to project rearwardly of the body, a propeller boss fitted to and connected to the propeller shaft, a plurality of propeller blades which are mounted to the propeller boss through a plurality of blade shafts disposed parallel to an axis of the propeller boss, and which can be turned between a closed position in which the propeller diameter is minimized, and an opened position in which the propeller diameter is maximized, the propeller boss being formed around an outer periphery thereof with a plurality of recesses and a plurality of land portions formed in a circumferentially alternate arrangement, a boss of each of the propeller blades being supported on a blade shaft carried on longitudinally opposite end walls of the recess and being accommodated in the recess, and each of the land portions being provided with an exhaust passage which extends longitudinally through the land portion to permit an exhaust outlet in the body of the propelling device to be opened at a rear end of the propeller boss.

With the above arrangement, the plurality of recesses and the plurality of land portions are formed in the circumferentially alternate arrangement around the outer periphery of the propeller boss, the boss of each propeller blade is supported on the blade shaft carried on longitudinally opposite end walls of the recess and is accommodated in the recess, and each of the land portions is provided with the exhaust passage which extends longitudinally through the land portion to permit the exhaust outlet in the body of the propelling device to be opened at the rear end of the propeller boss. Therefore, the exhaust passages each having a large sectional area can be defined in the propeller boss without being obstructed by the blade shafts. Thus, in the variable-diameter type propeller, discharge of an exhaust gas into water can be performed with only a small-resistance, while the blade shafts can be supported at opposite ends without obstruction by the exhaust passages. Moreover, the presence of the land portions between the recesses accommodating the bosses of the propeller blades contribute to a reduction in resistance against the rotation of the propeller boss.

In addition, if a cylindrical recess is provided in a front end face of the propeller boss to put the exhaust outlet into communication with each of the exhaust passages, an exhaust gas discharged through the exhaust outlet in the body of the propelling device can be equally distributed into the plurality of rotating exhaust passages through the cylindrical recess to contribute to a further reduction in exhaust resistance.

Further, each of the propeller blades may be rotatable along with the associated blade shaft to increase the propeller diameter in accordance with an increase in centrifugal force acting on such propeller blades, and all the blade shafts may be connected to one another through a synchronizer for synchronizing the rotations of the blade shafts. Thus, it is possible to automatically control the propeller diameter without use of a special actuator by utilizing the centrifugal force on each propeller blade. Moreover, the opened/closed angles of all the propeller blades can be equally controlled irrespective of a difference between the respective centrifugal forces and the like by the synchronous rotation of all the blade shafts. Therefore, it is possible to provide a variable-diameter type propeller which is simple in structure, inexpensive and stable in performance.

Yet further, a streamlined balance-weight may be added to a rear edge of each of the propeller blades with respect to a rotational direction, and may be formed so that at least a portion of the balance-weight can be attached and detached. With this arrangement, the revolution-number/diameter characteristic of the propeller can be changed or adjusted only by replacement of at least the portion of the balance-weight and moreover, because the balance-weight is of a streamlined shape, the water resistance to the rotation of the propeller is scarcely increased.

Yet further, bearing holes for supporting front and rear opposite ends of each of blade shafts may be provided in each of the recesses in the propeller boss. The front bearing hole may be defined as a through-hole to enable the blade shaft to be passed through such bearing hole, while the rear bearing hole may be defined as a bottomed hole to limit the rearward movement of the blade shaft. A common cover may be secured to the front end of the propeller boss in an opposed relation to the front ends of all the blade shafts for limiting the forward movement of the blade shafts. If the propeller is of such a construction, it is possible to provide a slip-off prevention for all the blade shafts only by securing the single cover to the propeller boss. This leads to a simple structure and a good assembling property. Moreover, the cover disposed at the front end of the propeller boss is covered with the body of the propelling device into a state isolated from the outside and hence, can be prevented from being brought into contact with other components.

Further, according to the present invention, there is provided a propeller for a boat, comprising a propeller shaft carried in a body of a propelling device to project rearwardly of the body, a propeller boss disposed rotatably about the propeller shaft, a torque limiting device for connecting the propeller shaft and the propeller boss in such a manner that a slip may be produced between the propeller shaft and the propeller boss, when a torque equal to or more than a predetermined value is received, and a plurality of propeller blades mounted to the propeller boss such that one of the diameter and pitch angle of the propeller can be changed, the torque limiting device being constructed by detachably securing an extension shaft to the propeller shaft to extend rearwardly of the propeller shaft, by rotatably fitting the propeller boss to the outer periphery of the extension shaft over its entire length, by supporting the propeller blades by a front portion of the propeller boss, and by filling a damper rubber between an inner peripheral surface of a rear portion of the propeller boss and an outer peripheral surface of the extension shaft.

With the above arrangement, the torque limiting device is constructed by detachably securing the extension shaft to the propeller shaft to extend rearwardly of the propeller shaft, rotatably fitting the propeller boss over the outer periphery of the extension shaft over its entire length, supporting the propeller blades on the front portion of the propeller boss, and filling the damper rubber between an inner peripheral surface of the rear portion of the propeller boss and the outer peripheral surface of the extension shaft. Therefore, it is possible to easily attach a variable-thrust type propeller having the torque limiting device to a short propeller shaft used for a usual propeller. Thus, if the variable-thrust type propeller is removed, a usual propeller can be attached directly to the propeller shaft. In the variable-thrust type propeller, the propeller blades and the torque limiting device are mounted in an axial arrangement on the propeller boss and hence, it is possible to place a larger-capacity torque limiting device without special formation of the propeller boss into a large diameter.

In addition, if the damper rubber baked to the outer peripheral surface of the extension shaft is press-fitted into an annular recess provided around the inner periphery of the rear portion of the propeller boss, it is possible to form a slip surface of the damper rubber into a large diameter to the utmost without obstruction by the propeller blades to easily provide an increase in capacity of the torque limiting device.

Further, a plurality of recesses and a plurality of land portions may be formed in a circumferentially alternate arrangement around an outer periphery of the front portion of the propeller boss. A base portion of the propeller blade may be accommodated in each of the recesses, and each of the land portions may have an exhaust passage provided therein to extend longitudinally through such land portion to permit an exhaust outlet in the body of the propelling device to be opened at the rear end of the propeller boss. Thus, it is possible to define the exhaust passages in the propeller boss without obstruction by the propeller blades, so that an exhaust gas from an engine can be discharged into water through the variable-thrust type propeller. Moreover, owing to the land portion formed between adjacent recesses each accommodating the base portion of the propeller blade, it is also possible to provide a reduction in resistance to the rotation of the propeller boss.

Yet further, blade shafts parallel to an axis of the propeller boss may be carried on longitudinally opposite end walls of the recess provided around the outer periphery of the propeller boss, and the boss of each of the propeller blades may be rotatably supported by the blade shaft. Thus, it is possible to define the exhaust passages each having a large sectional area in the propeller boss without obstruction by the blade shafts, leading to a contribution to a reduction in resistance to an exhaust gas, while enabling the blade shafts to be firmly supported at its opposite ends without obstruction by the exhaust passages.

Incidentally, the term "boat" mentioned herein should be understood to cover all kinds of boats and ships and any other marine and water vehicles to which the invention is applicable.

The above and other objects, features and advantages of the invention will become apparent from the following description of preferred embodiments, taken in conjunction with the accompanying drawings.

BRIEF DESCRIPTION OF THE DRAWINGS

FIGS. 1 to 8 illustrate a first embodiment of the present invention, wherein FIG. 1 is a partially vertical sectional view of an essential portion of a propeller system having a variable-diameter type propeller for a boat;

FIG. 2 is a vertically sectional enlarged view of a propeller portion shown in FIG. 1;

FIG. 3 is a sectional view taken along a line 3—3 in FIG. 2;

FIG. 4 is a sectional view taken along a line 4—4 in FIG. 2;

FIG. 5(*a*) is a sectional view taken along a line 5—5 in FIG. 2;

FIG. 5(*b*) is a view of an enlarged portion of FIG. 5(*a*)

FIG. 6 is a sectional view taken along a line 6—6 in FIG. 2;

FIG. 7 is a front view illustrating a modification to a structure for mounting a balance-weight to a propeller blade; and FIG. 8 is a sectional view taken along a line 8—8 in FIG. 7;

FIGS. 9 to 11 illustrate a second embodiment of the present invention, wherein FIG. 9 is a vertical sectional view of an essential portion of a propeller system having a variable-pitch type propeller for a boat;

FIG. 10 is a sectional view taken along a line 10—10 in FIG. 9;

FIG. 11 is a sectional view taken along a line 11—11 in FIG. 9;

FIGS. 13 to 19 illustrate a third embodiment of the present invention, wherein FIG. 13 is a partially sectional vertical view of an essential portion of a propeller system having a propeller for a boat;

FIG. 14 is an enlarged vertical sectional view of a propeller portion shown in FIG. 13;

FIG. 15 is a sectional view taken along a line 15—15 in FIG. 14:

FIG. 16 is a sectional view taken along a line 16—16 in FIG. 14;

FIG. 17 is a sectional view, similar to FIG. 16, but with some parts removed;

FIG. 18 is a view taken along an arrow 18 in FIG. 14; and

FIG. 19 is an exploded perspective view of an essential portion of the propeller.

DESCRIPTION OF THE PREFERRED EMBODIMENTS

The present invention will now be described by way of preferred embodiments in connection with the accompanying drawings.

Figure 1:
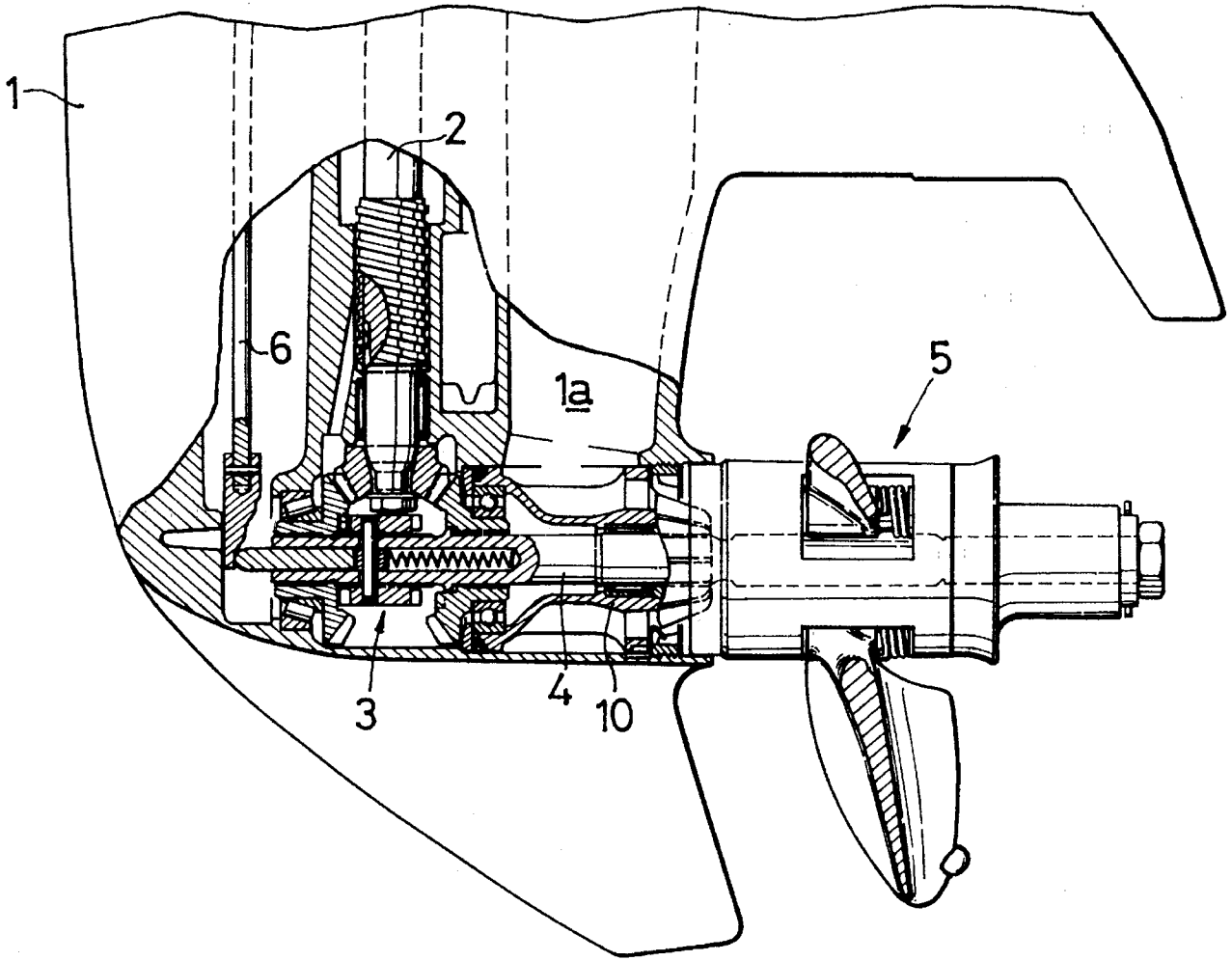

A first embodiment shown in FIGS. 1 to 8 will be first described. Referring to FIG. 1, carried on a body of a propelling device mounted on transom of a ship or boat are vertically-disposed driving shaft 2 driven from an engine which is not shown, and a horizontally-disposed propeller shaft 4 connected to the driving shaft 2 through a forward and backward gear mechanism 3. The propeller shaft 4 is used for a usual propeller and has a relatively short rearward projecting length from the body of the propelling device 1, and a variable-diameter type propeller 5 is mounted on the propeller shaft 4.

The forward and backward gear mechanism 3 is of a known bevel gear type and is switchable between a forward mode capable of driving the propeller shaft 4 in a forward direction and a backward mode capable of driving the propeller shaft 4 in a backward direction.

Figure 2:
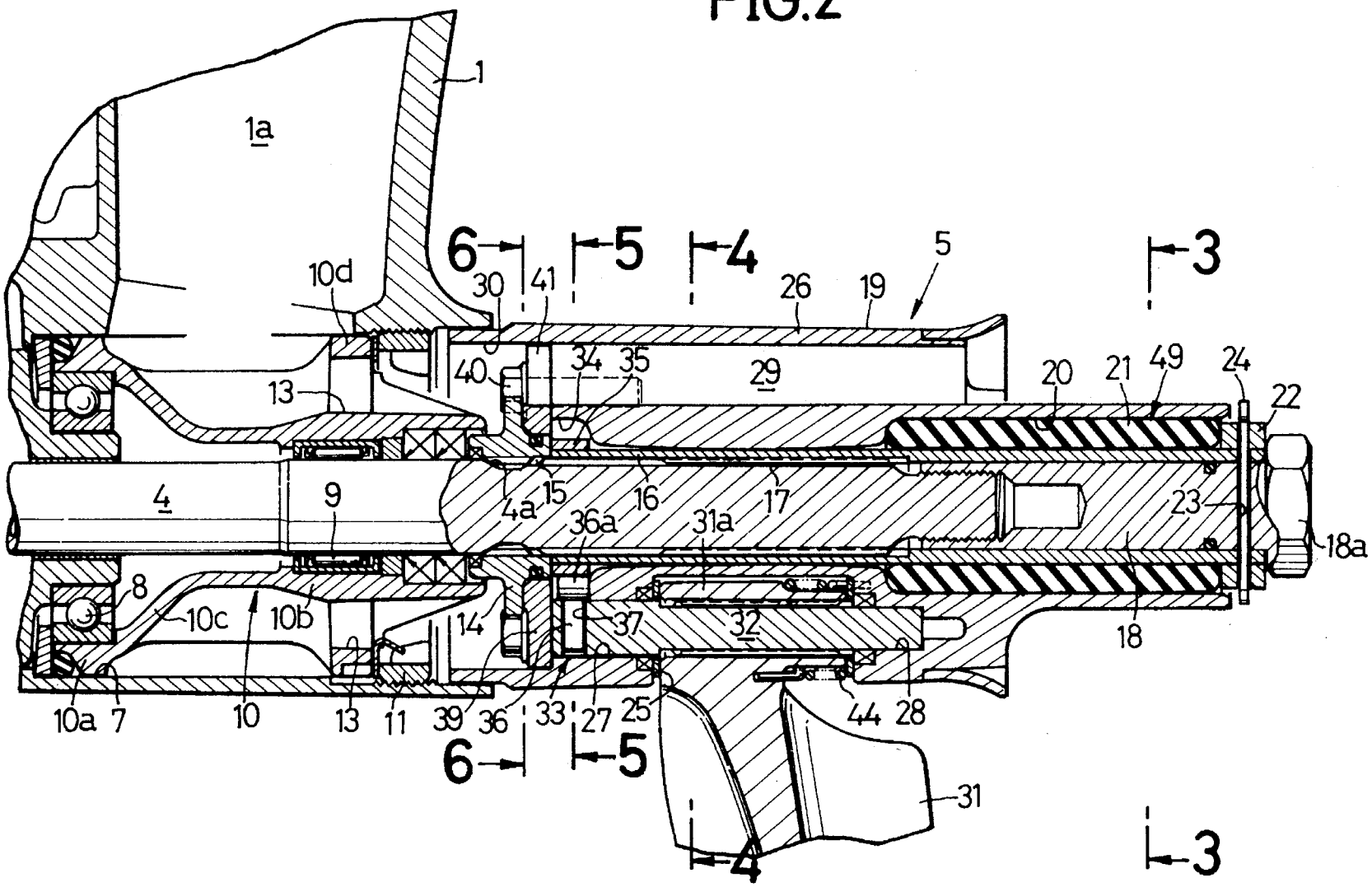

Referring to FIG. 2, a bearing holder 10 for holding a pair of front and rear bearings 8 and 9 used for carrying the propeller shaft 4 is fitted in a mounting hole 7 opened in a rear surface of the body of the propelling device 1. A ring nut 11 is also threadedly fitted in the mounting hole 7 for pressing the bearing holder 10 from the rearward. The bearing holder 10 includes a larger-diameter sleeve portion 10*a* for holding the front ball bearing 8, and a smaller-diameter sleeve portion 10*b* for holding the rear needle bearing 9. Both the sleeve portions 10*a* and 10*b* are integrally connected to each other through a tapered sleeve portion 10*c*. A flange 10*d* is integrally formed on the smaller-diameter portion 10*b* to project from an outer peripheral surface thereof and retained by the ring nut 11. A plurality of exhaust outlets 13 are provided in the flange 10*d* to communicate with an exhaust port of the engine through a hollow portion 1*a* in the body of the propelling device 1.

The construction of the variable-diameter type propeller 5 will be described in connection with FIGS. 2 to 6.

Referring to FIG. 2, a thrust plate 14 is fitted through a spline 15 over the propeller shaft 4 adjacent a rear end of the bearing holder 10. The thrust plate 14 is prevented from being moved forwardly by abutting against a tapered surface 4*a* of the propeller shaft 4. A hollow extension shaft 16 is also detachably fitted over the propeller shaft 4 with its front end abutting against the thrust plate 14 and with its rear end extending rearwardly from the propeller shaft 4. A rear end face of the extension shaft 16 is retained by a hexagon head 18*a* of an extended-axis cap nut 18 threadedly fitted over an outer periphery of the propeller shaft 4 at its rear end.

Figure 3:
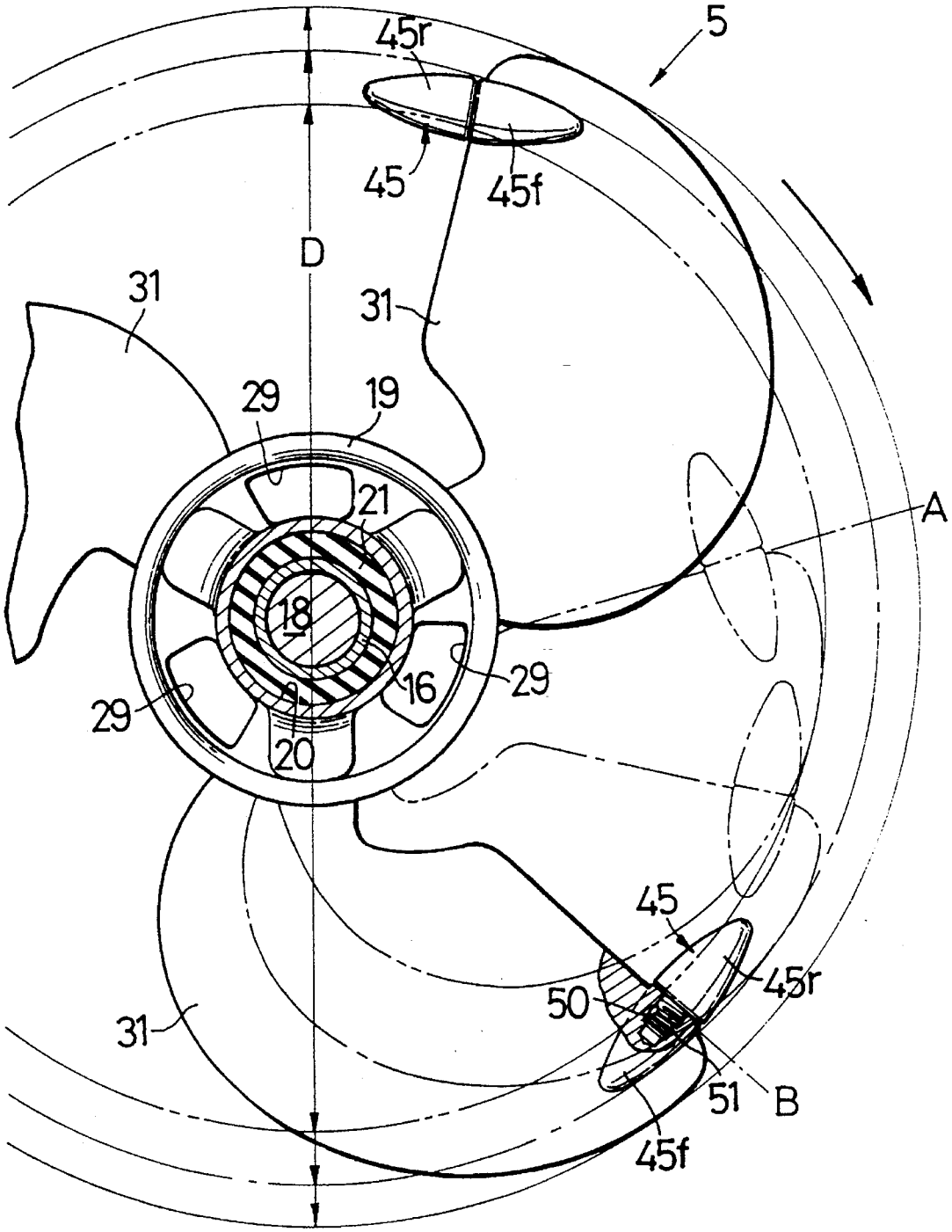

A propeller boss 19 is relatively rotatably fitted over an outer peripheral surface of the extension shaft 16 over its substantially entire length. As also shown in FIG. 3, an annular recess 20 is formed on an inner peripheral surface of a rear half of the propeller boss 19. A torque limiting device 49 is formed by press-fitting a cylindrical damper rubber 21 baked on that outer peripheral surface of the extension shaft 16 which faces the annular recess 20. The damper rubber 21 is connected to the propeller boss 19 with a given friction coefficient and adapted to slip relative to the propeller boss 19, if it receives a rotational torque of a given value or more.

In order to prevent a slip-off of the damper rubber 21, a retaining ring 22 is fitted over a rear end of the extension shaft 16, so that it is interposed between a rear end of the damper rubber 21 and the hexagon head 18*a* of the extended-axis cap nut 18, and a cotter pin 24 is mounted in a consecutive pin hole 23 provided through the retaining ring 22, the extension shaft 16 and the extended-axis cap nut 18. The cotter pin 24 prevents the turning of the extended-axis cap nut 18 relative to the propeller shaft 4.

Figure 4:
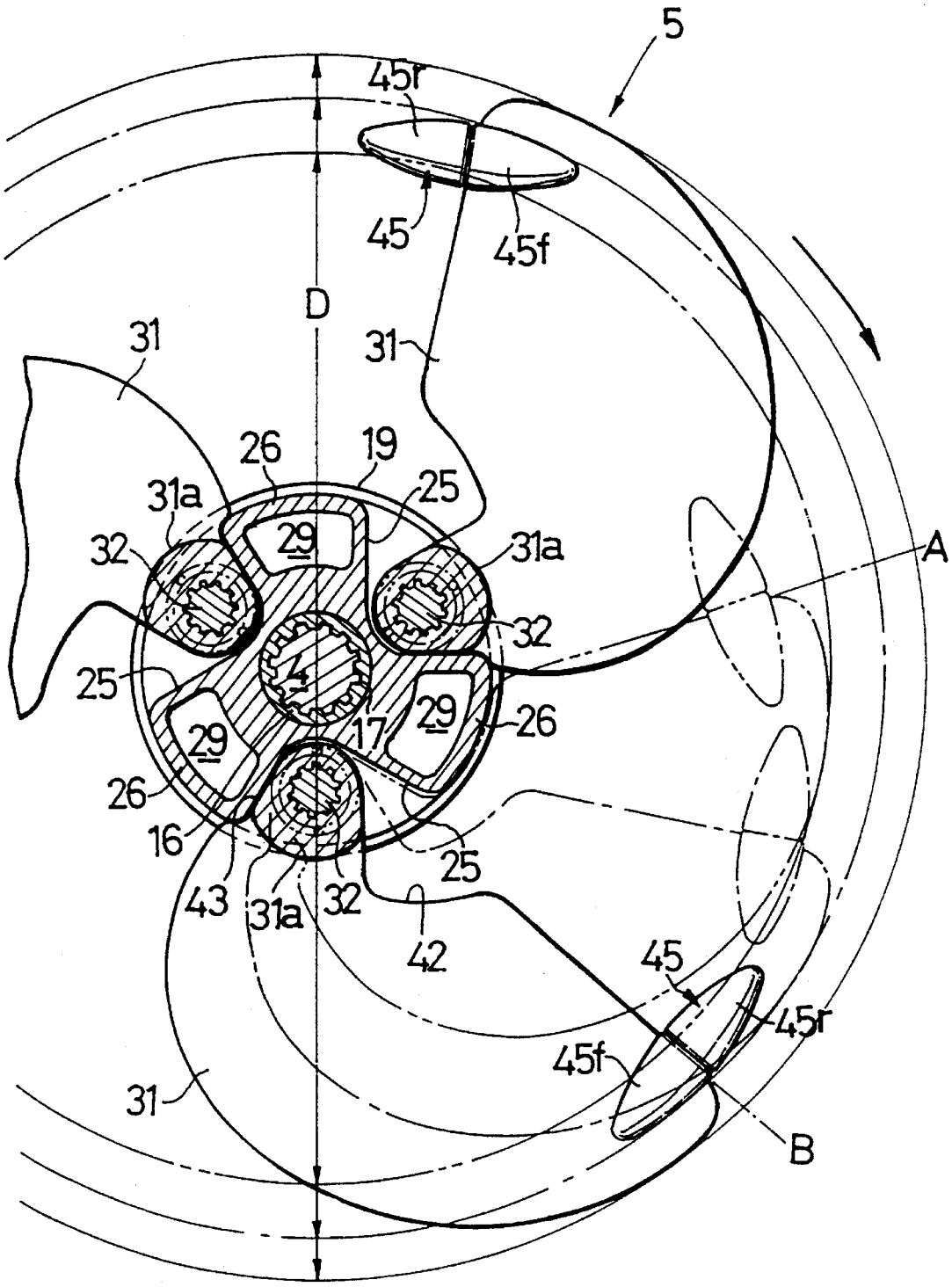

As shown in FIGS. 2 and 4, the propeller boss 19 is provided with three recesses 25 and three land portions 26 alternately arranged circumferentially in a front half of the propeller boss 19, a pair of front and rear bearing holes 27 and 28 opened in front and rear opposite sidewalls of each recess 25, three exhaust passages 29 provided in the land portions 26 respectively to axially extend through the propeller boss 19, and a cylindrical recess 30 opened in a front surface of the propeller boss 19 to accommodate the thrust plate 14. The exhaust passage 29 and the front bearing hole 27 are opened at the cylindrical recess 30. Therefore, the front bearing hole 27 is a through-hole with its front and rear opposite ends opened, while the rear bearing hole 28 is a bottomed hole with its rear end closed. A boss 31*a* of a propeller blade 31 is disposed in each of the recesses 25, and a blade shaft 32 is spline-fitted over the boss 31*a* and rotatably supported at its opposite ends in the bearing holes 27 and 28.

Figures 5A, 5B:
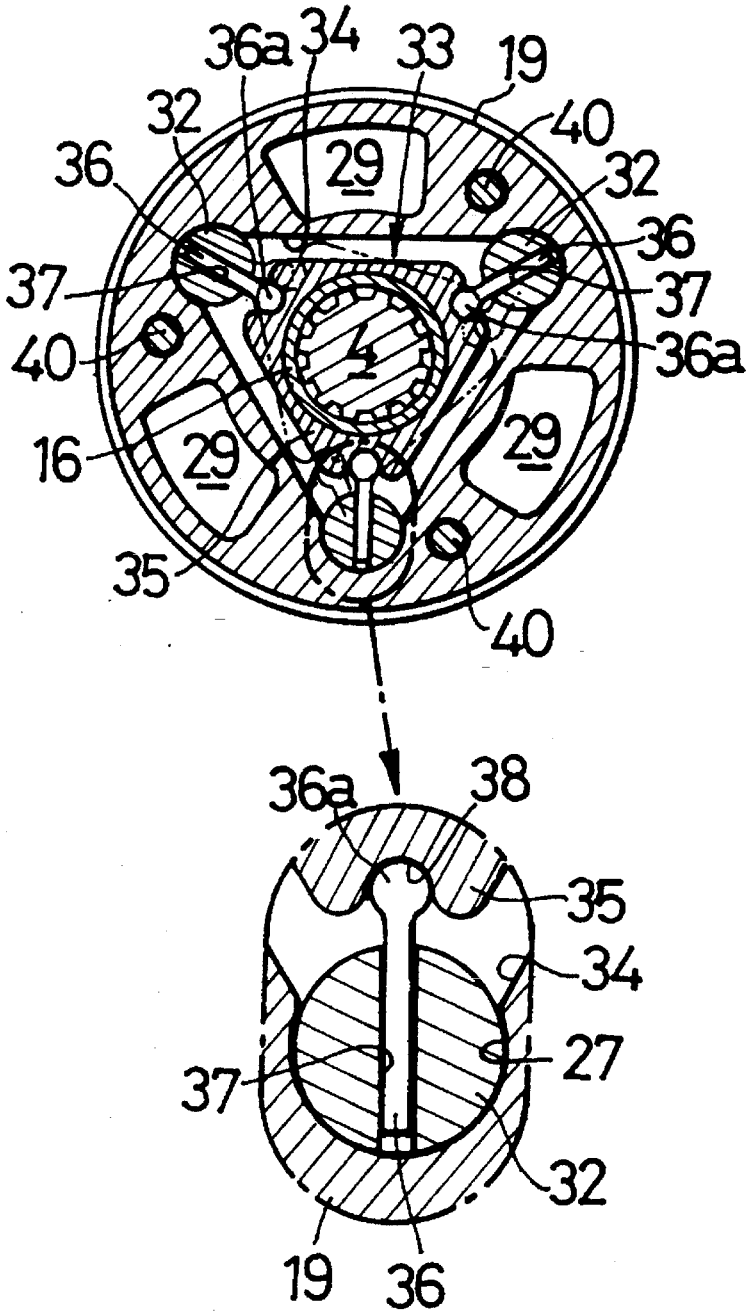

As shown in FIGS. 2 and 5(*a*), 5(*b*), all the blade shafts 32 are connected to one another by a synchronizer 33, so that they are rotated synchronously. The synchronizer 33 includes a triangular synchronizing plate 35 as a synchronizing member rotatably carried over the extension shaft 16 in a triangular recess 34 which is further recessed from a bottom surface of the cylindrical recess 30 to expose a portion of an outer peripheral surface of each blade shaft 32, and a synchronizing pin 36 as a synchronizing element fitted and supported in a transverse hole 37 opened at that outer peripheral surface of each blade shaft 32 which is exposed into the triangular recess 34. A connecting groove 38 is defined in each of apexes of the triangular synchronizing plate 35, and a cylindrical expanded portion 36*a* is formed at one end of the synchronizing pin 36 protruding from the transverse hole 37 to engage the corresponding connecting groove 38. All the blade shafts 32 can be rotated synchronously by limiting their rotational angles relative to one another through their own synchronizing pins 36 and the common synchronizing plate 35 during respective rotations.

In such synchronizer 33, the synchronizing plate 35 is disposed such that the exhaust passages 29 are located outside the sides of the triangle thereof. Thus, the exhaust passages 39 each having a large sectional area can be defined without obstruction by the synchronizing plate 35 and the synchronizing pins 36.

Figure 6:
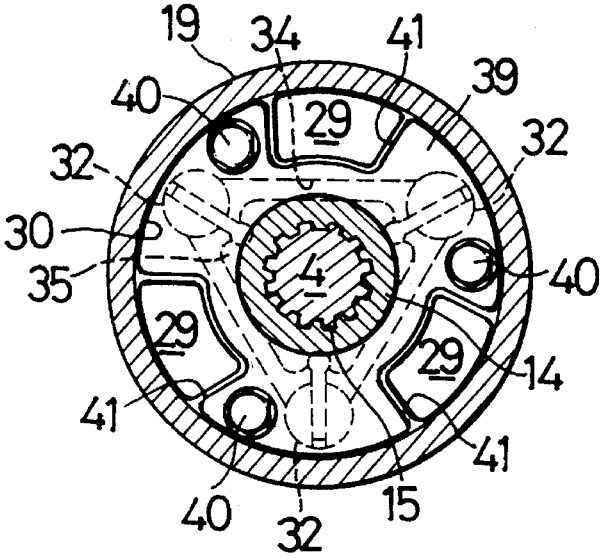

As shown in FIG. 6, in order to prevent the slip-off of the blade shafts 32 and the synchronizing plate 35, a cover 39 is secured to the bottom surface of the cylindrical recess 30 by bolts 40 to close the front bearing holes 27 and a triangular forwardly opened face. Particularly with regard to the blade shaft 32, the axial, i.e., longitudinal movement of the shaft 32 is limited by the cover 39 and a bottom wall of the rear bearing hole 28. Three notches 41 are provided in the cover 39, such that they do not close the three exhaust passages 29.

As shown in FIG. 4, each of the propeller blades 31 is turned along with the blade shaft 32 between a closed position A in which the propeller diameter D is minimized, and an opened position B in which the propeller diameter D is maximized. In order to limit the closed position A, a first stopper face 42 is formed at a rear end of each propeller blade 31 with respect to its rotational direction to abut against the outer peripheral surface of the propeller boss 19. In order to limit the opened position B, a second stopper face 43 is formed on the blade boss 31*a* to abut against one side of the recess 25.

Each of the propeller blade 31 is biased by a spring toward the closed position A, and for this purpose, a torsion coiled return spring 44 (FIG. 2) is mounted on the blade boss 31*a*.

Further, a streamlined balance-weight 45 is mounted to a rear end of each propeller blade 31 with respect to its rotational direction. This balance-weight 45 is divided into a front balance-weight portion 45*f* forming a front streamlined half and a rear balance-weight portion 45*r* forming a rear streamlined half. Division surfaces of these divided portions 45*f* and 45*r* are provided with a mounting hole 50 and a connecting shaft portion 51, respectively. The front balance-weight portion 45*f* is integrally formed on a rear edge of the propeller blade 31, and the rear balance-weight portion 45*r* is detachably coupled to the front balance-weight portion 45*f* by threaded mounting or press-fitting of the connecting shaft portion 51 into the mounting hole 50 in the front balance-weight portion 45*f*.

In changing or adjusting the revolution-number/diameter characteristic of the propeller 5 in this embodiment, the rear balance-weight portion 45*r* is removed from the front balance-weight portion 45*f* in each of the propeller blades 31, and another rear balance-weight portion 45*r* having a different weight is coupled to the front balance-weight portion 45*r*, thereby adjusting the weight of the propeller blade 31. In doing so, the magnitude of centrifugal force received by the propeller blade 31 at a predetermined number of revolutions of the propeller 5 is varied and thus, the characteristic of variation in diameter D of the propeller is varied.

Moreover, the balance-weight 45 is formed by coupling the front and rear balance-weight portions 45*f* and 45*r* into a streamlined shape and hence, the resistance of water is not increased almost at all during rotation of the propeller 5.

The operation of this embodiment will be described below.

In assembling the propeller 5, the extension shaft 16 with the damper 21 baked thereto is first fitted into the propeller boss 19 and then, the blade shaft 32 having the interlocking pin 36 is inserted from the front end side of the propeller boss 19 into the front and rear bearing holes 27 and 28 in sequence. The blade shaft 32 is spline-fitted into the boss 31*a* of the propeller blade 31 which is on standby in the recess 25 around the outer periphery of the propeller boss 10 during this time.

After the insertion of the blade shaft 32 to the bottom of the rear bearing hole 28, the interlocking plate 35 is accommodated into the triangular recess 34 at the front end of the propeller boss 19, and the expanded end portion 36*a* of the interlocking pin 36 is engaged into the connecting groove 38 in the interlocking plate 35. Finally, the cover 39 is secured to the bottom surface of the cylindrical recess 30 of the propeller boss 19 by the bolts 40, thus preventing the slip-off of all the blade shafts 32 and the interlocking plate 35.

By mounting the single cover 39 in this manner, not only the slip-off of the plurality of blade shafts 32 but also the slip-off of the interlocking plate 35 are prevented. Therefore, such slip-off preventing structure is an extremely simple structure which requires only a small number of parts, and is easy to assemble.

The propeller boss 19 having the torque limiting device 49, the propeller blades 31 and the synchronizer 33 assembled thereto in this manner is fitted over the propeller shaft 4 from the rearward, thereby causing extension shaft 16 to be spline coupled to the propeller shaft 4. Subsequently, the retaining ring 22 is fitted over the rear end of the extension shaft 16 and then, the extended-axis nut 18 is threadedly mounted to the propeller shaft 4.

Thus, the cover 39 and the bolts 40 disposed at the front end of the propeller boss 19 are covered with the body of the propelling device 1 and isolated from the outside and hence, can be avoided from the contact with other members.

If the propeller shaft 4 is driven from the driving shaft 2 through the forward and backward gear mechanism 3, the driving torque thereof is transmitted in sequence through the spline 17, the extension shaft 16 and the damper rubber 21 to the propeller boss 19, so that the propeller blades 31 are rotated along with the propeller boss 19 to generate a thrust.

In a low speed rotation region of the propeller boss 19, each of the propeller blades 31 is retained at the closed position A by a resilient force of the return spring 44 to provide the minimum diameter D of the propeller. Therefore, the generated thrust is relatively small, so that a trolling can easily be carried out.

If the rotational speed of the propeller boss 19 is then increased in excess of a given value, each of the propeller blades 31 is opened to an extent that the centrifugal force acting on the propeller blade 31 itself and the balance-weight 45 is balanced with the resilient force of the return spring 44. When a predetermined high speed rotation region is entered, each propeller blade 31 reaches the maximal open position B to provide the maximum diameter D of the propeller, so that a large thrust is generated to enable a cruising at a high speed.

During this time, the blade shafts 32 of all the propeller blades 31 are rotated synchronously with one another through the synchronizer 33, as described above. Thus, a dispersion in opened angle due to a difference in centrifugal forces acting on the propeller blades 31 and in resilient force of the return spring 44, a water resistance and other external factors can be eliminated to provide a stabilized performance of the propeller 5 at all times.

When a small obstacle such as a floating object strikes the propeller blade 31 during cruising, a torsional deformation of the damper rubber 21 can be produced to moderate the shock force applied to the propeller blade 31. When a large obstacle such as a rock strikes the propeller blade 31, a slip is produced between the fitted surfaces of the damper rubber 21 and the propeller boss 19, and the propeller shaft 4 races relative to the propeller boss 19. This makes it possible to block an overload on the propeller blades 31 and the power-transmitting system.

An exhaust gas from the engine which is not shown is discharged into the hollow 1*a* in the body of the propelling device 1. This exhaust gas is passed through the exhaust outlet 13 in the bearing holder 10 into the cylindrical recess 30 of the propeller boss 19, then diverted therefrom into the three exhaust passages 29 and released into the water. Therefore, even during rotation of the propeller boss 19, the distribution of the exhaust gas into the three exhaust passages 29 can be equalized. Moreover, each of the exhaust passages 29 is formed so as to pass between the axis of the propeller boss 19 and each of the three parallel blade shafts 32. Therefore, a necessary and sufficient sectional area can be insured without obstruction by each of the blade shafts 32 and without an attendant increase in diameter of the propeller boss 19. This contributes to a reduction in resistance to the discharge of the exhaust gas in cooperation with the equalized distribution of the exhaust gas. Each of the blade shafts 32 can be supported at its opposite ends by the pair of front and rear bearing holes 27 and 28 without obstruction by each of the exhaust passages 29, thereby firmly supporting each of the propeller blades 31. In this way, the structure for supporting the blade shafts 32 is rational and hence, even if the propeller boss 19 is made of aluminum alloy, a demand for the strength can be satisfied.

Since the damper rubber 21 of the torque limiting device 49 is interposed between the extension shaft 16 and the propeller boss 19 in the rear of the recess 25 accommodating the blade boss 31*a*, it is possible to employ a large volume damper rubber 21 without obstruction by the blade boss 31*a*. Moreover, since the inner peripheral surface of the damper rubber 21 is baked to the extension shaft 16 and the outer peripheral surface thereof is in press contact with the inner peripheral surface of the annular recess 20 in the inner periphery of the rear half of the propeller boss 19, it is possible to establish the slip surface of the damper rubber 21 at a larger diameter to the utmost without obstruction by the propeller blades 31 and hence, to easily provide the torque limiting device 49 of a type having a large torque capacity.

When a usual propeller having stationary blades is required, the extension shaft 16 is removed, and a boss of the usual propeller is spline-fitted over the propeller shaft 4. Then, a nut is threadedly fitted to the rear end of the propeller shaft 4 to press such boss to the thrust plate 14. Therefore, the replacement of the propeller shaft is not required.

Figure 8:
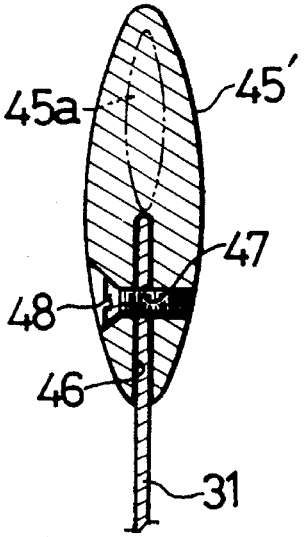
Figure 7:
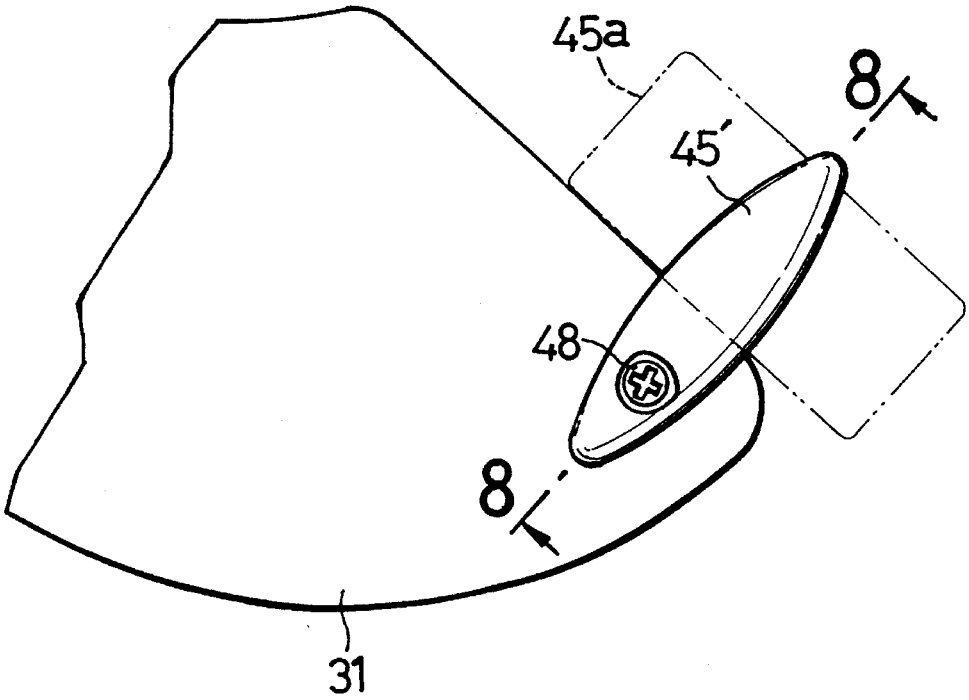

FIGS. 7 and 8 illustrate a modification to the structure for mounting the balance-weight 45 to the propeller blade 31. More specifically, a streamlined balance-weight 45' is formed independently from the propeller blade 31 and has a slit 46 in a front half thereof. This balance-weight 45' is secured to the propeller blade 31 by inserting it over the rear edge of the propeller blade 31 and threadedly inserting a machine screw 48 into the balance-weight 45' to penetrate a through-hole 47 in the propeller blade 31. A blade-profiled additional balance-weight 45*a* may be integrally connected to the balance-weight 45' to extend along the rear edge of the propeller blade 31, as shown by a dashed line.

In this modification, the entire balance-weight 45' can be replaced by balance-weight having a different weight by detaching and attaching of the machine screw 48, and the balance-weight 45' can be attached even to the propeller blade for which the addition of the balance-weight is taken into consideration, thereby adjusting the weight thereof.

Figure 9:
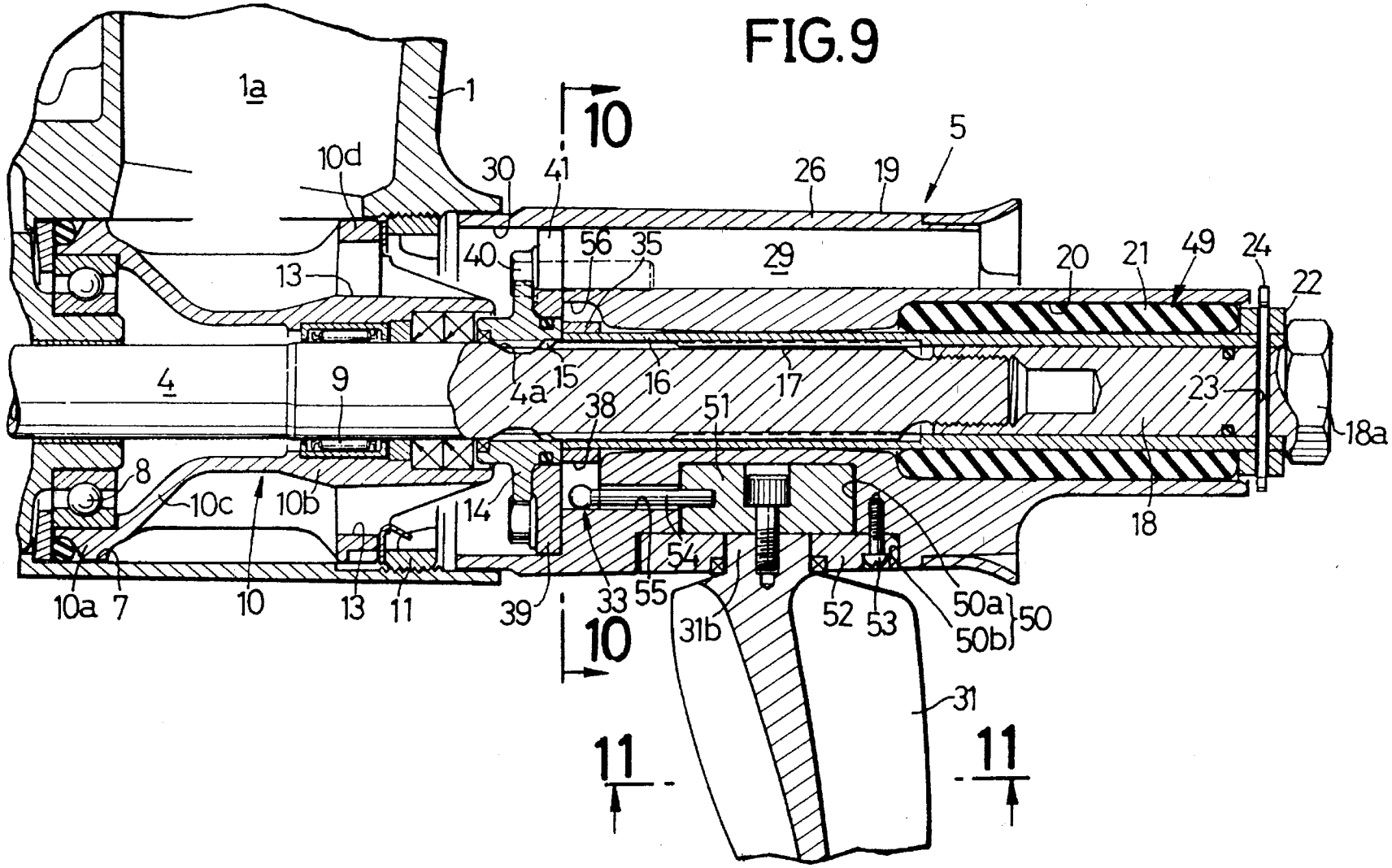
Figure 10:
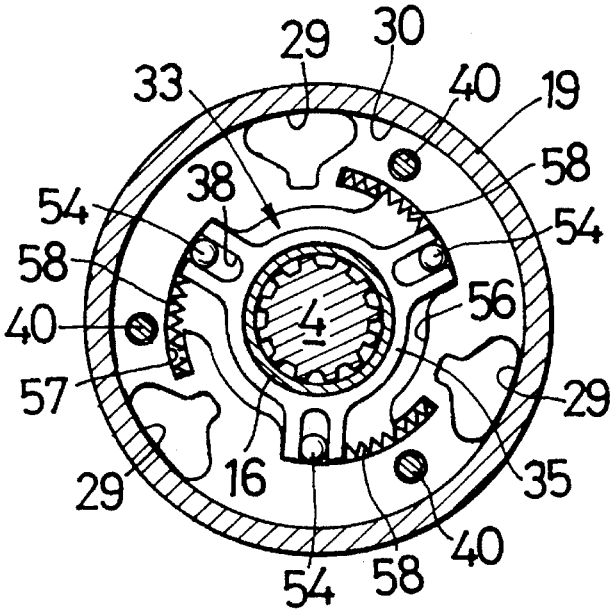
Figure 11:
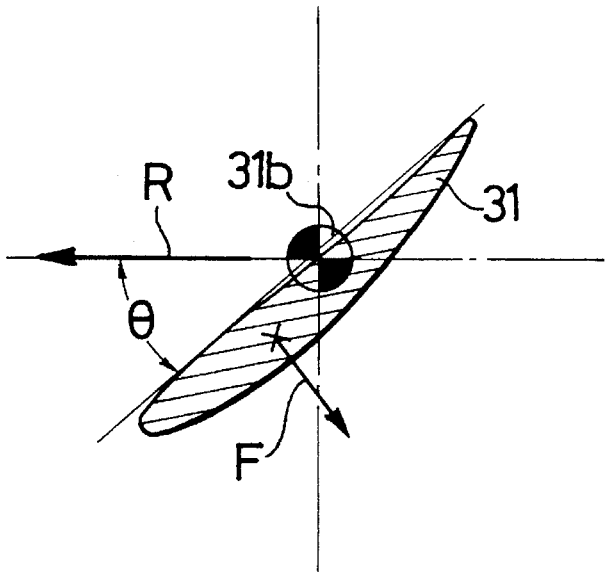

FIGS. 9 to 11 illustrate a second embodiment of the present invention applied to a variable-pitch type propeller. Referring to FIGS. 9 and 10, a circular stepped recess 50, in place of the recess 25 in the first embodiment, is defined around an outer periphery of a front half of a propeller boss 19. A rotatable plate 51 secured to a neck shaft 31*b* at the base end of a propeller blade 31 is fitted in an inner small-diameter recess 50*a* of the stepped recess 50. And a retaining plate 52 for rotatably supporting the neck shaft 31*b* is fitted in an outer large-diameter recess 50*b* and secured to the propeller boss 19 by a machine screw 53.

A synchronizer 33 for synchronizing the controls of the pitch angles of the propeller blades 31 includes synchronizing pins 54 embedded in outer peripheral surfaces of the rotatable plates 51 respectively and connected at their tip ends to a common synchronizing plate 35. In this case, the synchronizing pin 54 is disposed in a cavity in the propeller boss 19, such that it can be swung with the rotation of the rotatable plate 51. The synchronizing plate 35 is accommodated in a limiting recess 56 defined in the propeller boss 19 in place of the triangular recess 34 in the previous embodiment, and the angle of rotation of the synchronizing plate 35 is limited by the limiting recess 56 so as to control the pitch angle θ (FIG. 11) of each of the propeller blades 31 from the minimum value to the maximum value. A return spring 58 is compressed in a single or a plurality of pockets 57 connected to the limiting recess 56 for biasing the synchronizing plate 35 in a direction to provide a minimum pitch angle θ of the propeller blades 31.

As shown in FIG. 11, during rotation of the propeller boss 19 in a normal direction, each of the propeller blades 31 is rotated in a direction indicated by an arrow R. In this case, the propeller blade 31 is formed, so that the center of a lifting power F produced on a back of the propeller blade 31 occupies a position offset from the center of the neck shaft 31*b* of the propeller blade 31 toward an front edge of the blade.

Therefore, in a low speed rotation region for the propeller boss 19, each of the propeller blades 31 is retained at a minimum pitch angle position by a resilient force of the return spring 58. However, if the number of revolutions of the propeller boss 19 is increased to a predetermined value or more, each of the propeller blades 31 is rotated about the neck shaft 31*b* to increase the pitch angle, until an attendant increased lifting power F is balanced with the resilient force of the return spring 58.

Other constructions are similar to those in the previous embodiment and hence, portions or components corresponding to those in the previous embodiment are designated by the same reference characters, and the description of them is omitted.

Figure 12:
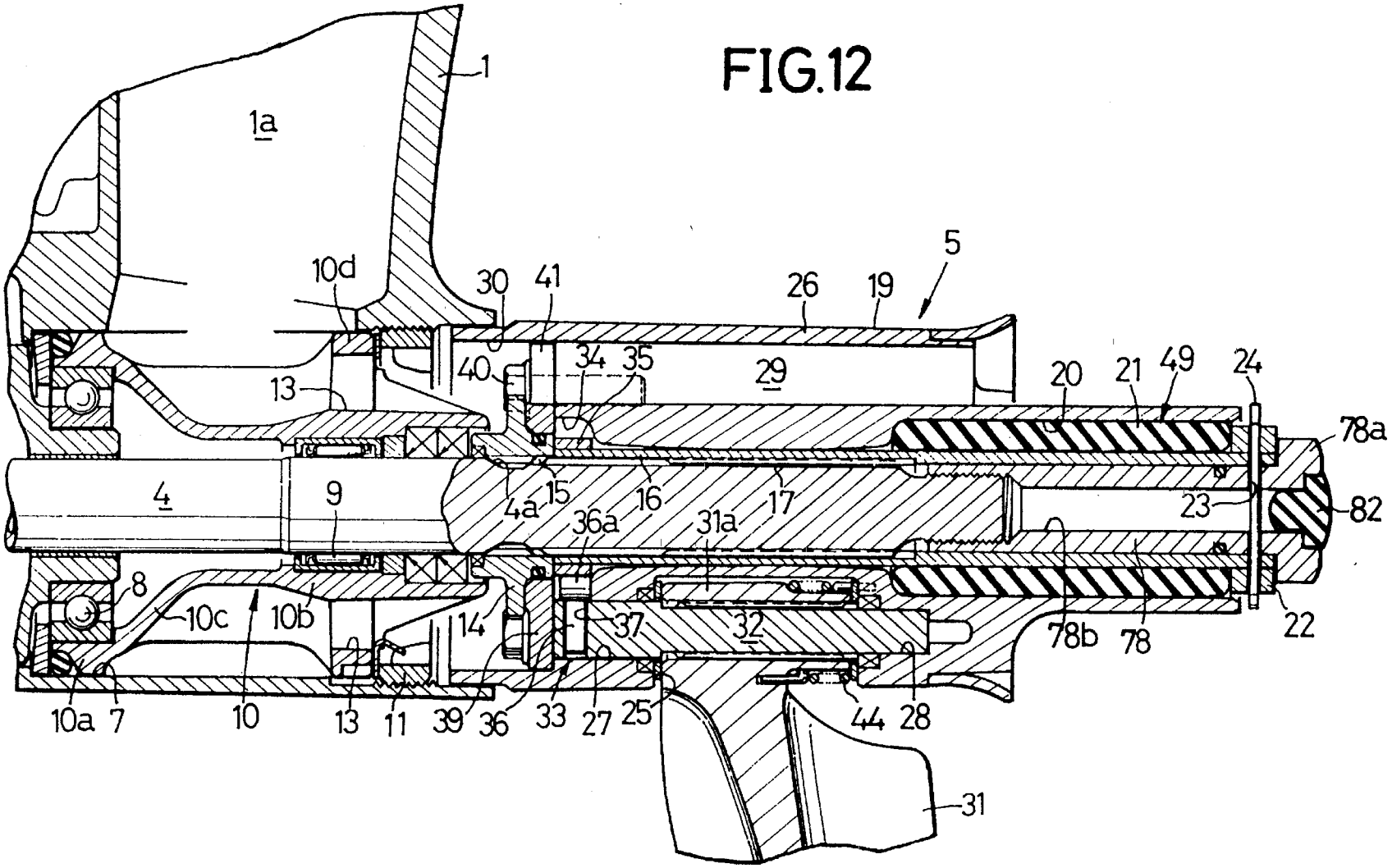
FIG. 12 is a vertical sectional view similar to the FIG. 9, but illustrating a modification to the first embodiment.
Figure 13:
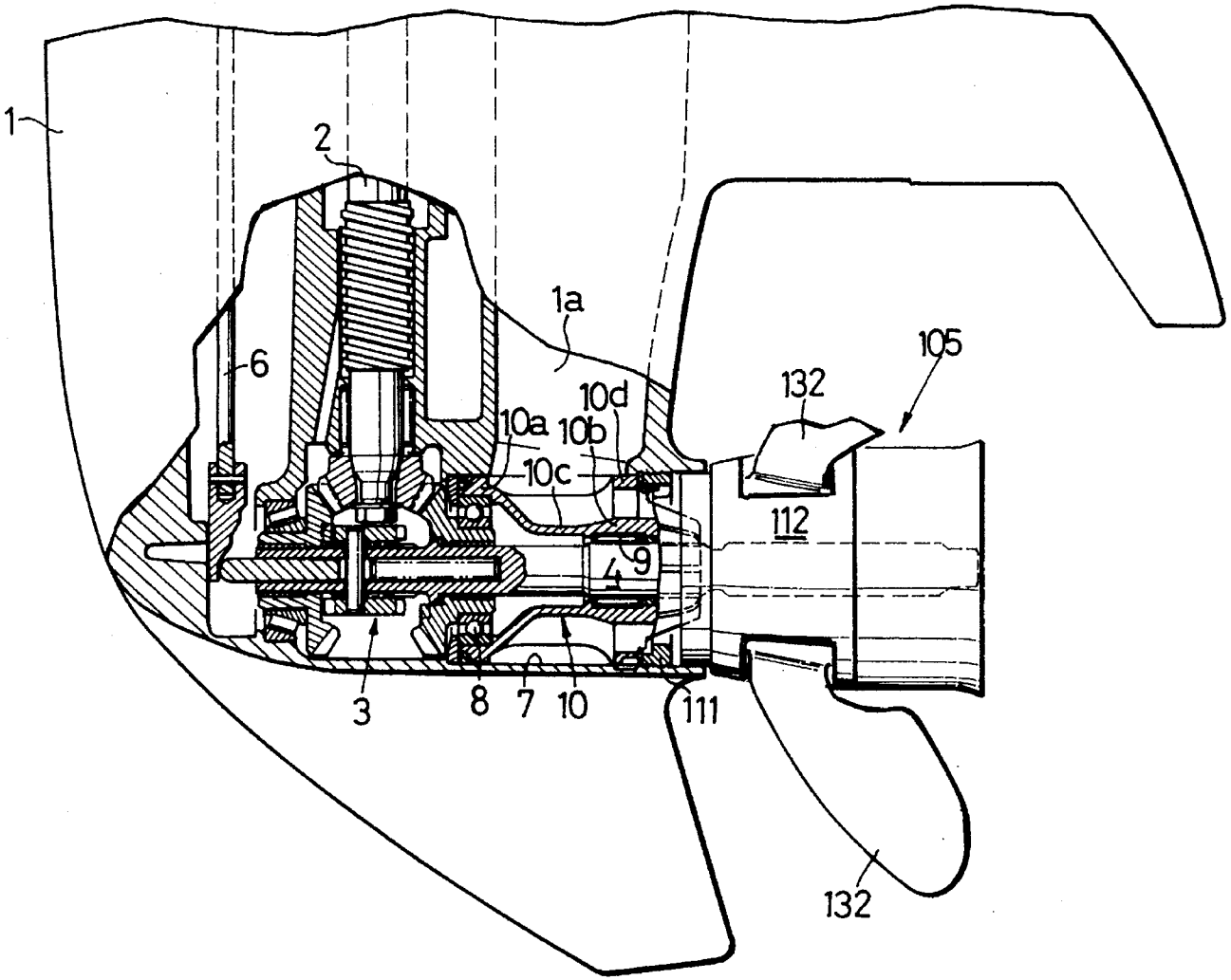

FIG. 12 is a vertical sectional view similar to FIG. 2, but illustrating a modification in which the extended-axis nut 18 in the first embodiment is replaced by an extended-axis nut 78 having a different structure. In this modification, the extended-axis nut 78 has a hollow 78*b* opened at a hexagon head 78*a*. Therefore, in order to check whether or not the tightening of the extended-axis nut over the propeller shaft 4 has been reliably performed, it is effective to insert a depth gauge into the hollow 78*b* in the extended-axis nut 78 from the rearward of the latter to measure a depth to a rear end face of the propeller shaft 4. After such checking, the rear opened end of the hollow 78*b* in the extended-axis nut 78 is occluded by a rubber plug 82. The other constructions is the same as in the first embodiment.

FIGS. 13 to 19 illustrate a third embodiment. In this embodiment, a propeller boss for supporting propeller blades and a torque limiting device are vertically disposed concentrically about a propeller shaft, unlike the previously-described embodiments. The third embodiment will be described below mainly with respect to structures different from those in the previously-described embodiments.

Figure 14:
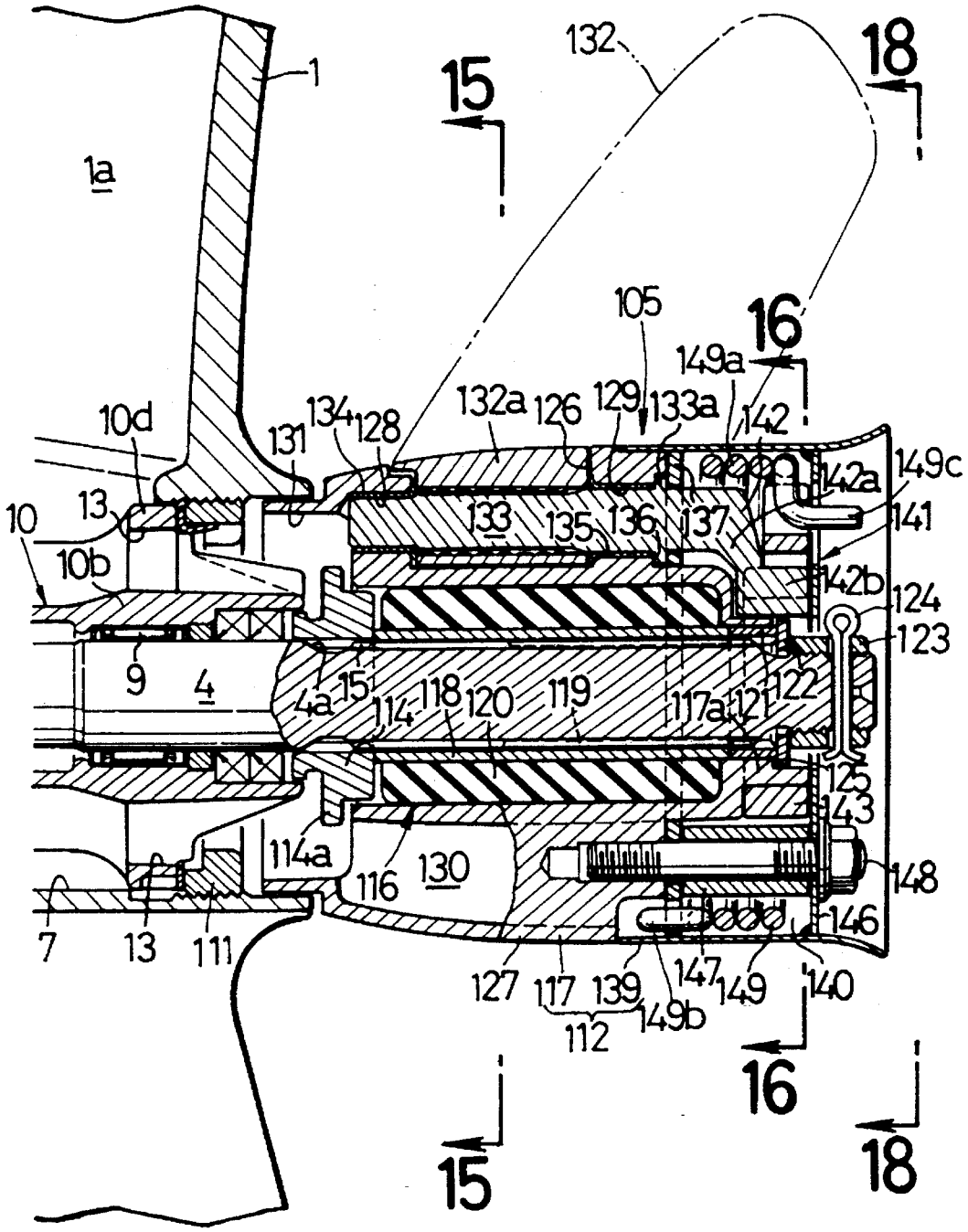

Referring to FIG. 14, a thrust ring 114 is fitted through a spline 15 over the propeller shaft 4 adjacent the rear end of the bearing holder 10. The thrust ring 114 abuts against the tapered surface 4*a* of the propeller shaft 4, and thus a forward movement of the ring 114 is prevented.

In the rear of the thrust ring 114, a boss body 117 of a propeller boss 112 is connected to the propeller shaft 4 through a torque limiting device 116. The torque limiting device 116 and the boss body 117 are disposed in a concentrically superposed relation about the propeller shaft 4.

The torque limiting device 116 includes a sleeve 118 detachably fitted over the propeller shaft 4 through a spline 119, and a damper rubber 120 baked to an outer peripheral surface of the sleeve 118 and press-fitted to an inner peripheral surface of the boss body 117. The damper rubber 120 is connected to the boss body 117 with a predetermined frictional force, so that if a rotational torque equal to or more than a predetermined value is received, a slipping is produced between the damper rubber 120 and the boss body 117.

An extension collar 121 is spline-fitted over the propeller shaft 4 to abut against a rear end of the sleeve 118. A nut 123 is threadedly fitted over a rear end of the propeller shaft 4 for retaining a rear end of the extension collar 121 through a thrust washer 122 having a diameter larger than that of the extension collar 121. An anti-loosening cotter pin 124 is inserted into the nut 123 and the propeller shaft 4. The extension collar 121 and the sleeve 118 correspond to the extension shaft in the previously described embodiments and may be formed integrally with each other. The boss body 117 includes a positioning boss 117*a* projecting rearwardly from an end face covering a rear end of the damper rubber 120 and rotatably fitted over the extension collar 121, whereby the concentric position of the boss body 117 relative to the propeller shaft 4 is maintained. The positioning boss 117*a* is formed into a cylindrical shape to surround the thrust washer 122. The boss 117*a* is provided at its inner peripheral surface with a shoulder 125 which is opposed to a front surface of the thrust washer 122. A rearward thrust applied to the boss body 117 is received by the thrust washer 122 through the shoulder 125. In this case, a flange may be formed around an outer periphery of a rear end of the extension collar 121 and may be put into abutment against the shoulder 125.

A front end face of the boss body 117 is opposed to a flange 114*a* formed around the outer periphery of the thrust ring 114, so that a forward thrust applied to the boss body 117 is received by the flange 114*a*.

Figure 15:
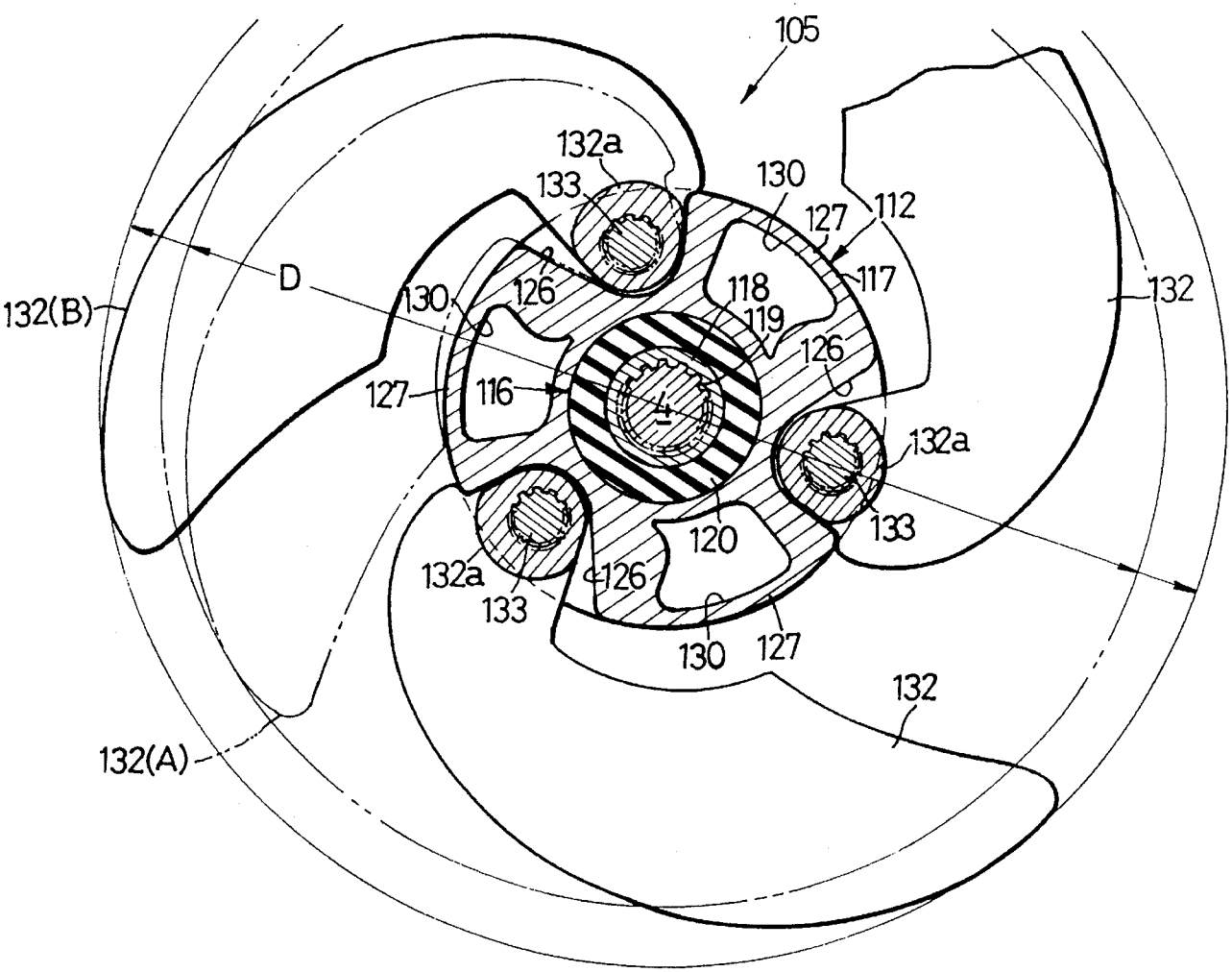
Figure 16:
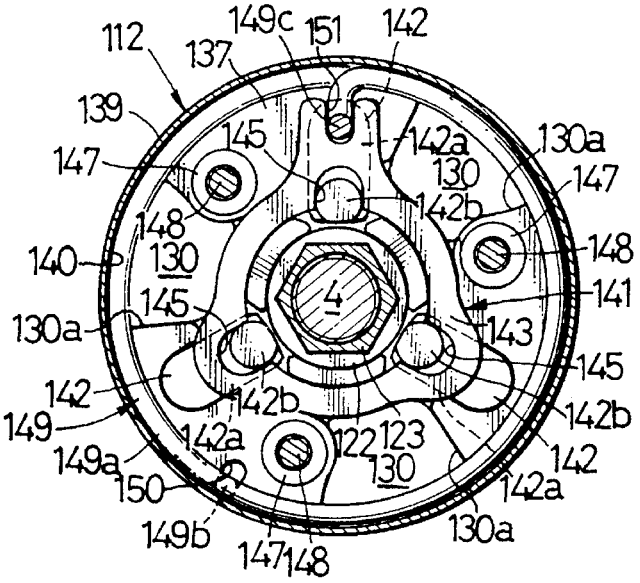
Figure 17:
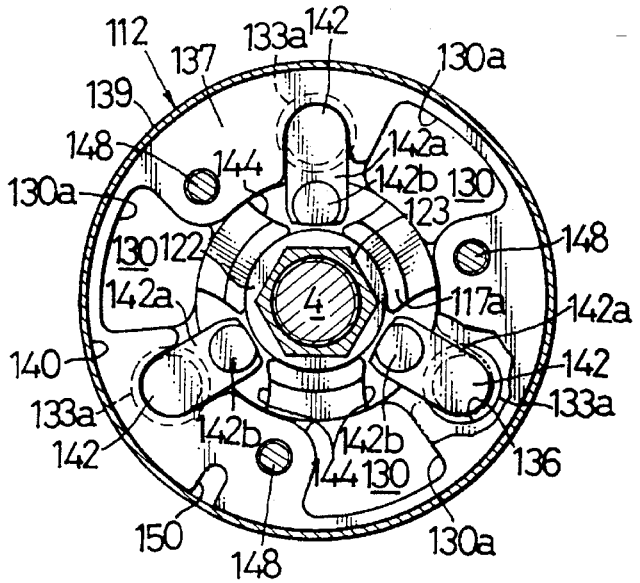

Referring to FIGS. 14 and 15, provided in the boss body 117 are three recesses 126 opened at an outer peripheral surface of the boss body 117 and arranged circumferentially at equal distances with its bottom surface located in proximity to an outer peripheral surface of the damper rubber 120, a pair of bearing holes 128 and 129 opened at longitudinally opposite end walls of each of the recesses 126, three exhaust passages 130 each extending axially through a land portion 127 sandwiched between the adjacent recesses 126, and a cylindrical recess 131 permitting the communication between the exhaust passages 130 and the exhaust outlet 13. A front end of the boss body 117 defining the cylindrical recess 131 is rotatably inserted in a rear opening of the mounting hole 7.

A boss 132*a* of a propeller blade 132 is accommodated in each of the recesses 126 in the boss body 117. A blade shaft 133 spline-fitted over the boss 132*a* are rotatably carried at longitudinally opposite ends of the shaft 133 in the bearing holes 128 and 129 with bushes 134 and 135 of a synthetic resin interposed therebetween, respectively. In this manner, the three blade shafts 133 are disposed in parallel to the propeller shaft 4 to surround the latter.

Each of the blade shafts 133 is provided with a flange 133*a* which is rotatably accommodated in a circular recess 136 defined in the rear opening of the rear bearing hole 129. A retaining plate 137 common to the blade shafts 133 for retaining the flanges 133*a* from the rearward to fix the axial positions of the blade shafts is secured to a rear end face of the propeller boss 112 by bolts 148 which will be described hereinafter. The retaining plate 137 is provided with exhaust holes 130(*a*) aligned with the exhaust passages 130.

Each of the propeller blades 132 is rotatable along with the blade shaft 133 between a closed position A to provide a minimum diameter D of the propeller and an opened position B to provide a maximum diameter D of the propeller. The closed and opened positions A and B are limited by abutment of the propeller blade 132 against an inner wall of the recess 126.

Figure 18:
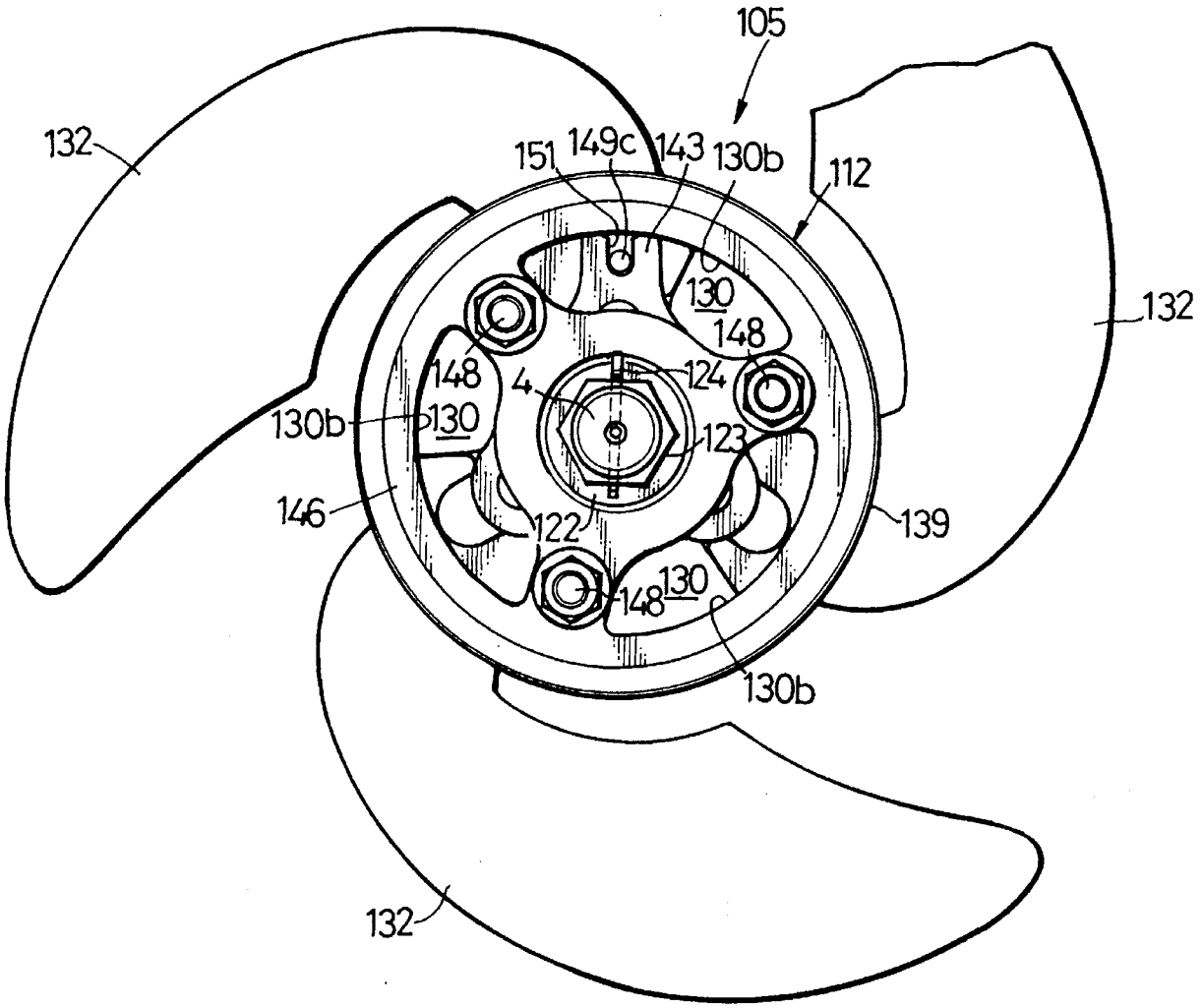
Figure 19:
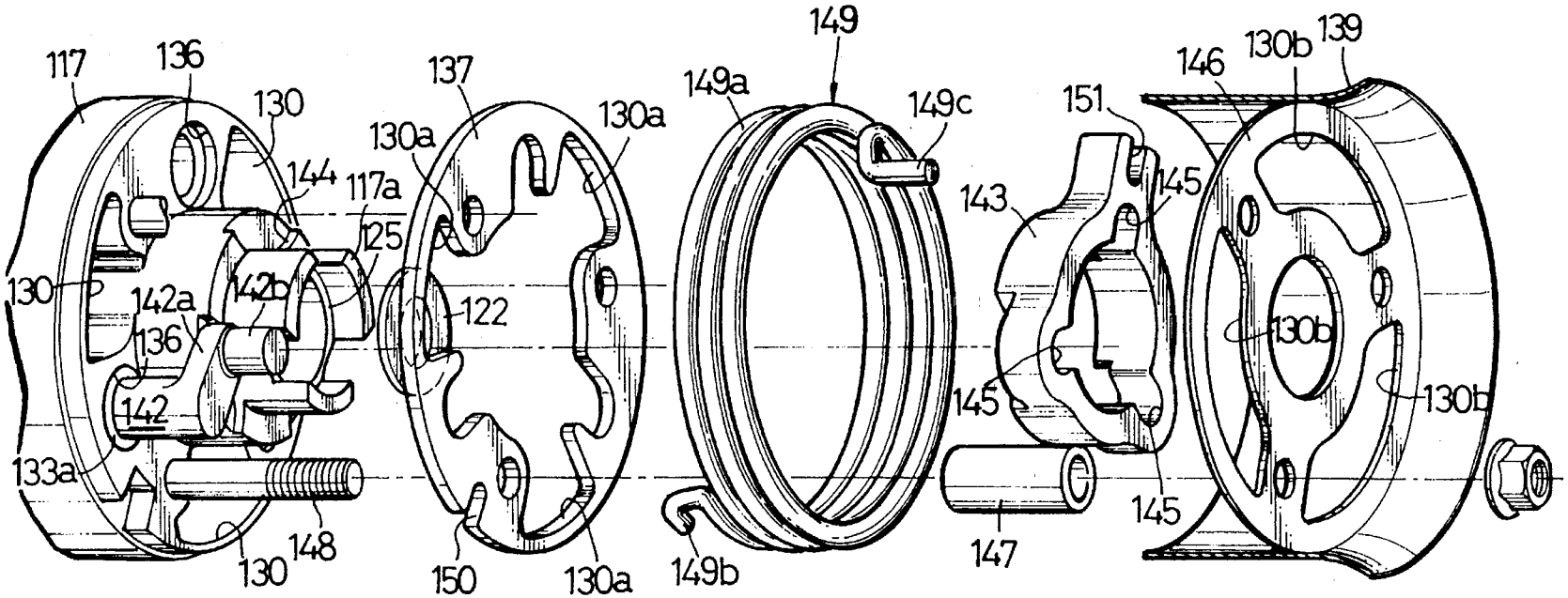

As shown in FIGS. 14, 18 and 19, the propeller boss 112 is constructed by fitting a diffuser pipe 139 of a small wall thickness to the rear end of the boss body 117 in such a manner that outer peripheral surfaces of both the pipe 139 and boss body 117 are continuous to each other. A mounting plate 146 is welded to an inner peripheral wall of the diffuser pipe 139 and secured to the rear end face of the boss body 117 by bolts 148 in a manner to sandwich a distance collar 147 and the retaining plate 137. The mounting plate 146 is provided with exhaust holes 130*b* at locations corresponding to the exhaust passages 130. The mounting plate 146 is disposed to define a synchronizer chamber 140 between the mounting plate 146 itself and the rear end face of the boss body 117. A synchronizer 141 is formed in the synchronizer chamber 140 for synchronously interlocking all the propeller blades 132 with one another.

More specifically, as shown in FIGS. 14, 16, 17 and 19, the synchronizer 141 includes cranks 142 as synchronizing elements integrally and continuously formed to the rear ends of the blade shafts 133, a single synchronizing ring 143 rotatably carried around the outer periphery of the positioning boss 117*a*. A rear surface of the ring 143 is retained by the mounting plate 146 of the diffuser pipe 139, so that it is prevented from being removed from the positioning boss 117*a*.

The crank 142 has a crank arm 142*a* bent from the blade shaft 133 toward the propeller shaft 4, and a crank pin 142*b* is provided at a tip end of the crank arm 142*a* and swingably received in a circular cutout 144 made around the outer periphery of the positioning boss 117*a*. The synchronizing ring 143 is provided with three U-shaped engage grooves 145 opened at its inner peripheral surface, and the crank pins 142*b* are slidably received in the engage grooves 145, respectively. The synchronizing ring 143 is formed into a substantially triangular contour, so that it does not cover the three exhaust passages 130 from the rearward. Thus, all the blade shafts 133 can be rotated synchronously by limiting the rotational angles with one another through the respective corresponding cranks 142 and the common synchronizing ring 143.

A return spring 149 is contained in the synchronizer chamber 140 for biasing all the propeller blades 132 for rotation toward the closed positions A via the synchronizer 141. The return spring 149 includes a torsion coiled spring and has a coiled portion 149*a* which is disposed along the inner peripheral surface of the diffuser pipe 139 to surround all the cranks 142. Locking claws 149*b* and 149*c* are formed at front and rear opposite ends of the coiled portion 149*a* and engaged in engage grooves 150 and 151 formed in the retaining plate 137 and the synchronizing ring 143, respectively.

The operation of this embodiment will be described below. If the propeller shaft 4 is driven from the driving shaft 2 through the forward and backward gear mechanism 3 by the operation of the engine which is not shown, the driving torque thereof is transmitted through the sleeve 118 and the damper rubber 120 to the propeller boss 112, and further from the blade shafts 133 to the propeller blades 132. Therefore, the propeller blades 132 are rotated along with the propeller boss 112 to generate a thrust.

An exhaust gas discharged from the engine into the hollow 1*a* of the body of the propelling device 1 is discharged through the exhaust outlet 13 of the bearing holder 10 into the cylindrical recess 131 of the boss body 117, and diverted therefrom into the three exhaust passages 130 and then, sequentially through the exhaust holes 130*a* in the retaining plate 137, the synchronizer chamber 140, and the exhaust holes 130*b* in the mounting plate 146, i.e., through the diffuser pipe 139 into the water.

Since the damper rubber 120 of the torque limiting device 116 is disposed in the concentrically superposed relation to the boss body 117, the boss body 117 can be formed of an axial length substantially equal to that of a usual propeller having stationary blades. Therefore, it is possible to attach the boss body 117 to a relatively short propeller shaft to which the usual propeller has been conventionally attached. Moreover, since the propeller blade 132 is formed into a variable-diameter type with its boss 132*a* accommodated in the recess 126 in the outer peripheral surface of the boss body 117 and supported by the blade shaft 133 parallel to the propeller shaft 4, it is possible to inhibit an increase in diameter of the boss body 117 to the utmost, while sufficiently insuring the capacity of the torque limiting device.

In the synchronizer 141, the crank arm 142*a* is bent from the rear end of the blade shaft 133 toward the propeller shaft 4, and the crank pin 142*b* is received in the cutout 144 provided around the outer periphery of the positioning boss 117 and is further engaged by the synchronizing ring 143, as described above. Therefore, it is possible to achieve a reduction in diameter of the synchronizing ring 143 and a compactness of the entire synchronizer 141, and to easily accommodate the synchronizer 141 in the narrow synchronizer chamber 140 within the diffuser pipe 139.

Further, since the common return spring 149 for biasing the synchronizing ring 143 in a direction to close all the propeller blades 132 while surrounding the crank arms 142*b* is contained in the synchronizer chamber 140, the single return spring 149 is only required for all the propeller blades 132 and moreover, the return spring 149 is protected against an obstacle, along with the synchronizer 141.

What is claimed is:

1. A propeller for a boat, comprising a propeller shaft carried in a body of a propelling device to protect rearwardly of said body, a propeller boss fitted to and connected to said propeller shaft, a plurality of propeller blades which are mounted to said propeller boss through a plurality of blade shafts disposed parallel to an axis of said propeller boss, and which can be turned between a closed position in which a propeller diameter is minimized, and an opened position in which the propeller diameter is maximized, said propeller boss being formed around an outer periphery thereof with a plurality of recesses and a plurality of land portions in a circumferentially alternate arrangement, a boss of each of the propeller blades being supported on said blade shaft carried on longitudinally opposite end walls of the recess and being accommodated in the recess, and each of said land portions being provided with an exhaust passage which extends longitudinally through said land portion to permit an exhaust outlet of the body of the propelling device to be opened at a rear end of the propeller boss.

2. A propeller for a boat according to claim 1, further including a cylindrical recess provided in a front end face of said propeller boss to put said exhaust outlet into communication with each of said exhaust passages.

3. A propeller for a boat according to claim 1, wherein each of said propeller blades is rotatable along with the associated blade shaft to increase the propeller diameter in accordance with an increase in a centrifugal force acting on said propeller blade, and all the blade shafts are connected to one another through a synchronizer for synchronizing rotations of said blade shafts.

4. A propeller for a boat according to claim 3, wherein said synchronizer is comprised of synchronizing elements projectingly provided at one end of said plurality of said blade shafts, respectively, and a synchronizing member provided in the propeller boss for rotation about said axis of the propeller boss and having a plurality of grooves engaged by tip ends of all the synchronizing elements, respectively.

5. A propeller for a boat according to claim 4, wherein each of said synchronizing elements is a synchronizing pin projectingly mounted on one side of said blade shaft, and said synchronizing member is a synchronizing plate having said grooves provided around an outer periphery thereof.

6. A propeller for a boat according to claim 4, wherein said synchronizing member is formed into a polygon, apexes of said polygon being portions having said grooves, and said exhaust passages are provided to communicate with exteriors of sides of said polygon.

7. A propeller for a boat according to claim 1, further including a streamlined balance-weight mounted to a rear edge of each of said propeller blades with respect to a rotational direction thereof, said balance-weight being formed so that at least a portion thereof can be attached to and detached from said propeller blade.

8. A propeller for a boat according to claim 7, wherein said balance-weight is comprised of a front weight portion integrally formed on the rear edge of said propeller blade, and a rear weight portion having a connecting shaft portion coupled to a mounting hole opened at a rear end face of said front weight portion.

9. A propeller for a boat according to claim 7, wherein said balance-weight has a slit defined in a front half thereof so as to extend along an axis of the balance-weight, and the rear edge of said propeller blade is inserted into said slit to secure said balance-weight to the propeller blade.

10. A propeller for a boat according to claim 1, wherein each of said blade shafts is supported at front and rear opposite ends of the blade shaft by front and rear bearing holes provided in said longitudinally opposite end walls of each of said recesses, said front bearing hole being formed as a through-hole to enable said blade shaft to be passed through said front bearing hole, while said rear bearing hole is formed as a bottomed hole to limit a rearward movement of said blade shaft; and said propeller further comprises a common cover secured to a front end of said propeller boss in an opposed relation with respect to the front ends of all the blade shafts for limiting forward movements of said blade shafts.

11. A propeller for a boat according to claim 10, wherein the boss of each of the propeller blades is spline-coupled to the blade shaft, and said propeller boss has a recess provided in a front end face thereof for accommodating a synchronizer connecting all the blade shafts to one another, said recess being closed by said cover.

12. A propeller for a boat, comprising a propeller shaft carried in a body of a propelling device to project rearwardly of said body;

a propeller boss disposed rotatably about said propeller shaft;

a torque limiting device for connecting said propeller shaft and said propeller boss in such a manner that a slip is produced between said propeller shaft and said propeller boss, when a torque equal to or more than a predetermined value is received; and a plurality of propeller blades mounted to said propeller boss such that one of a diameter and a pitch angle of said propeller can be changed, said torque limiting device being constructed by detachably securing an extension shaft to said propeller shaft to extend rearwardly of said propeller shaft, by rotatably fitting said propeller boss to an outer periphery of said extension shaft over substantially an entire length of the extension shaft, by supporting said propeller blades on a front portion of said propeller boss, and by filling a damper rubber between an inner peripheral surface of a rear portion of said propeller boss and an outer peripheral surface of said extension shaft.

13. A propeller for a boat according to claim 12, wherein said damper rubber is baked to the outer peripheral surface of said extension shaft and is press-fitted into an annular recess provided around the inner peripheral surface of the rear portion of said propeller boss.

14. A propeller for a boat according to claim 12 or 13, wherein said propeller boss has a plurality of recesses and a plurality of land portions which are formed in a circumferentially alternate arrangement around an outer periphery of the front portion of said propeller boss, a base portion of each said propeller blade being accommodated in each of said recesses, and each of said land portions being provided with an exhaust passage to extend longitudinally through said land portion to permit an exhaust outlet in said body of the propelling device to be opened at a rear end of said propeller boss.

15. A propeller for a boat according to claim 14, further comprising a blade shaft which is parallel to an axis of said propeller boss, and is carried on longitudinally opposite end walls of each of the recesses, and wherein each of said propeller blades has a boss rotatably supported by said blade shaft.

16. A propeller for a boat according to claim 12, wherein said plurality of propeller blades are mounted to said propeller boss through the plurality of blade shafts disposed in parallel to an axis of said propeller boss to surround the axis thereof, each of said propeller blades being rotatable along with the associated blade shaft to increase the propeller diameter in accordance with an increase in a centrifugal force acting on said propeller blade, and all said blade shafts are connected to one another through a synchronizer for synchronizing rotations of said blade shafts.

17. A propeller for a boat according to claim 16, wherein said synchronizer is comprised of synchronizing elements projectingly provided at one end of said blade shafts, respectively, and a synchronizing member provided in the propeller boss for rotation about said axis of the propeller boss and having a plurality of grooves engaged by tip ends of all the synchronizing elements, respectively.

18. A propeller for a boat according to claim 17, wherein each of said synchronizing elements is a synchronizing pin projectingly mounted on one side of said blade shaft, and said synchronizing member is a synchronizing plate having said grooves provided around an outer periphery thereof.

19. A propeller for a boat according to claim 12, wherein each of said propeller blades is provided at a base end thereof with a neck shaft rotatably mounted to said propeller boss, each of said propeller blades being rotatable along with said neck shaft to increase the pitch angle in accordance with an increase in a lifting power acting on said propeller blade, all said neck shafts being connected to one another through a synchronizer for synchronizing rotations of said neck shafts.

20. A propeller for a boat according to claim 19, wherein said synchronizer is comprised of synchronizing pins connected to the neck shafts for turning movement within said propeller boss with the rotations of said neck shafts, respectively, and a synchronizing plate provided at an outer periphery thereof with a plurality of connecting grooves engaged by tip ends of all said synchronizing pins, respectively.

21. A propeller for a boat according to claim 20, wherein said synchronizing plate is formed into a polygon, apexes of said polygon being portions having said connecting grooves, and said propeller boss has a plurality of exhaust passages provided therein to extend exterior of sides of said polygon to permit an exhaust outlet in the body of the propelling device to be opened at a rear end of said propeller boss.

22. A propeller for a boat according to claim 12, wherein said plurality of propeller blades are pivotally supported for opening and closing to increase the diameter of the propeller in accordance with an increase in centrifugal force received by said propeller blades, each of said propeller blades having a streamlined balance-weight mounted to a rear edge of the propeller blade with respect to a rotational direction, said balance-weight being formed such that at least a portion thereof can be attached to and detached from said propeller blade.

23. A propeller for a boat according to claim 22, wherein said balance-weight comprises a front weight portion integrally formed on the rear edge of said propeller blade, and a rear weight portion having a connecting shaft portion coupled to a mounting hole opened at a rear end face of said front weight portion.

24. A propeller for a boat according to claim 22, wherein said balance-weight has a slit defined in a front half thereof so as to extend along an axis of the balance-weight, and the rear edge of said propeller blade is inserted into said slit to secure said balance-weight to the propeller blade.

25. A propeller for a boat according to claim 12, wherein said propeller boss is provided around an outer periphery thereof with a plurality of recesses for accommodating bosses of said propeller blades, and a plurality of blade shafts being provided for rotatably supporting the bosses of said propeller blades and extending parallel to an axis of the propeller boss, each of the blade shafts being supported at front and rear opposite ends thereof by front and rear bearing holes provided in front and rear opposite end walls of each of said recesses, said front bearing hole being formed as a through-hole to enable said blade shaft to be passed through said front bearing hole, while said rear bearing hole is formed as a bottomed hole to limit a rearward movement of said blade shaft; and wherein said propeller further comprises a common cover secured to a front end of said propeller boss in an opposed relation with respect to front ends of all the blade shafts for limiting forward movements of said blade shafts.

26. A propeller for a boat according to claim 25, wherein the boss of each of the propeller blades is spline-coupled to the blade shaft, and said propeller boss has a recess provided in a front end face thereof for accommodating a synchronizer for connecting all the blade shafts to one another, said recess being closed by said cover.

27. A propeller for a boat, comprising:

a propeller shaft carried in a body of a propelling device, a propeller boss for mounting to said propeller shaft, a plurality of propeller blades mounted to said propeller boss through a plurality of blade shafts disposed parallel to an axis of said propeller boss, and which can be turned between a closed position in which a propeller diameter is minimized, and an opened position in which the propeller diameter is maximized, said propeller boss being formed around an outer periphery thereof with a plurality of recesses and a plurality of land portions in a circumferentially alternate arrangement, a boss of each of the propeller blades being supported on said blade shaft carried on longitudinally opposite end walls of the recess and being accommodated in the recess, and each of said land portions being provided with an exhaust passage which extends longitudinally through said land portion.

28. A propeller for a boat according to claim 27, further including a cylindrical recess provided in a front end face of said propeller boss to put an exhaust outlet in the body of the propelling device into communication with each of said exhaust passages.

29. A propeller for a boat according to claim 27, wherein each of said propeller blades is rotatable along with the associated blade shaft to increase the propeller diameter in accordance with an increase in a centrifugal force acting on said propeller blade, and all the blade shafts are connected to one another through a synchronizer for synchronizing rotations of said blade shafts.

30. A propeller for a boat according to claim 29, wherein said synchronizer is comprised of synchronizing elements projectingly provided at one end of said plurality of said blade shafts, respectively, and a synchronizing member provided in the propeller boss for rotation about said axis of the propeller boss and having a plurality of grooves engaged by tip ends of all the synchronizing elements, respectively.

31. A propeller for a boat according to claim 30, wherein each of said synchronizing elements is a synchronizing pin projectingly mounted on one side of said blade shaft, and said synchronizing member is a synchronizing plate having said grooves provided around an outer periphery thereof.

32. A propeller for a boat according to claim 30, wherein said synchronizing member is formed into a polygon, apexes of said polygon being portions having said grooves, and said exhaust passages are provided to communicate with exteriors of sides of said polygon.

33. A propeller for a boat according to claim 27, wherein each of said blade shafts is supported at front and rear opposite ends of the blade shaft by front and rear bearing holes provided in said longitudinally opposite end walls of each of said recesses, said front bearing hole being formed as a through-hole to enable said blade shaft to be passed through said front bearing hole, while said rear bearing hole is formed as a bottomed hole to limit a rearward movement of said blade shaft; and said propeller further comprises a common cover secured to a front end of said propeller boss in an opposed relation with respect to the front ends of all the blade shafts for limiting forward movements of said blade shafts.

34. A propeller for a boat according to claim 33, wherein the boss of each of the propeller blades is spline-coupled to the blade shaft, and said propeller boss has a recess provided in a front end face thereof for accommodating a synchronizer connecting all the blade shafts to one another, said recess being closed by said cover.

* * * * *